US009492044B2

(12) United States Patent
Lv

(10) Patent No.: US 9,492,044 B2
(45) Date of Patent: Nov. 15, 2016

(54) GLASS WIPING DEVICE AND CONTROL METHOD THEREOF

(75) Inventor: Xiaoming Lv, Suzhou (CN)

(73) Assignee: Ecovacs Robotics Co., Ltd., Suzhou (CN)

( * ) Notice: Subject to any disclaimer, the term of this patent is extended or adjusted under 35 U.S.C. 154(b) by 248 days.

(21) Appl. No.: 14/241,781

(22) PCT Filed: Aug. 16, 2012

(86) PCT No.: PCT/CN2012/080207

§ 371 (c)(1),
(2), (4) Date: Feb. 27, 2014

(87) PCT Pub. No.: WO2013/029469

PCT Pub. Date: Mar. 7, 2013

(65) Prior Publication Data

US 2014/0202495 A1 Jul. 24, 2014

(30) Foreign Application Priority Data

Aug. 29, 2011 (CN) ..... 2011 1 0250145

(51) Int. Cl.

| | |
|---|---|
| ***A47L 1/03*** | (2006.01) |
| ***A47L 1/02*** | (2006.01) |
| ***A47L 1/12*** | (2006.01) |

(52) U.S. Cl.
CPC .. *A47L 1/03* (2013.01); *A47L 1/02* (2013.01); *A47L 1/12* (2013.01)

(58) Field of Classification Search
CPC ..... A47L 1/03; A47L 1/02; A47L 1/12
USPC ..... 134/6; 15/102, 103, 250.11, 250.12
See application file for complete search history.

(56) References Cited

U.S. PATENT DOCUMENTS

| | | | |
|---|---|---|---|
| 3,751,750 | A | 8/1973 | Kaftan |
| 2007/0251036 | A1 | 11/2007 | Remer |

(Continued)

FOREIGN PATENT DOCUMENTS

| | | |
|---|---|---|
| CN | 2353304 | 12/1999 |
| CN | 2475366 | 2/2002 |

(Continued)

OTHER PUBLICATIONS

Extended European Search Report for PCT/CN2012/080207 (dated Jan. 7, 2015)(5 Pages).

(Continued)

*Primary Examiner* — Saeed T Chaudhry
(74) *Attorney, Agent, or Firm* — Nixon Peabody LLP

(57) ABSTRACT

A glass wiping device and a control method thereof are provided. The glass wiping device comprising a driver mechanism (110) and a follower mechanism (120); the driver mechanism (110) and the follower mechanism (120) are respectively provided with a first magnet unit and a second magnet unit; the magnetic force between the first magnet unit and the second magnet unit enables the driver mechanisms (110) and the follower mechanism (120) to be correspondingly adsorbed on the inside and outside of the glass, and the follower mechanism (120) can follow the driver mechanism (110); the driver mechanism (110) or the follower mechanism (120) is provided with a pressure induction unit and a pressure indicating device (121) thereon; the pressure induction unit comprises a pressure sensor (41) and a controller (42); the pressure sensor (41) is used to sense the pressure of the driver mechanism (110) and the follower mechanism (120) against the glass; after receiving a pressure signal transmitted by the pressure sensor (41), the controller (42) controls the pressure indicating device (121) to display a relevant state. The control method comprising the following steps: a), placing the driver mechanism (110) or the follower mechanism (120) on one side of the glass; b) placing the follower mechanism (120) or the driver mechanism (10) at a corresponding position on the other side of the glass; and c) the controller (42) controls the pressure indicating device (121) to display the relevant state after receiving the pressure signal transmitted by the pressure sensor (41).

13 Claims, 5 Drawing Sheets

(56) References Cited

U.S. PATENT DOCUMENTS

| | | | | |
|---|---|---|---|---|
| 2009/0106925 | A1 | 4/2009 | Cheyne | |
| 2013/0014782 | A1* | 1/2013 | Ryu | A47L 1/03 134/6 |

FOREIGN PATENT DOCUMENTS

| | | | | |
|---|---|---|---|---|
| CN | 2669777 | | 1/2005 | |
| CN | 201179035 | Y | 1/2009 | |
| CN | 201675857 | U | 12/2010 | |
| CN | 201899440 | U | 7/2011 | |
| CN | 202235141 | U | 5/2012 | |
| JP | 9-504973 | | 5/1997 | |
| JP | 2001346723 | A | 12/2001 | |
| JP | 2009219831 | A | 10/2009 | |
| KR | 10-2009-0128110 | A | 12/2009 | A47L 1/03 |
| KR | 20110031016 | A | 3/2011 | |
| WO | WO 2007/027044 | A1 | 3/2007 | A47L 1/03 |

OTHER PUBLICATIONS

Written Opinion of the International Searching Authority for PCT/CN2012/080207, mail date Nov. 22, 2012.

* cited by examiner

GLASS WIPING DEVICE AND CONTROL METHOD THEREOF

CROSS-REFERENCE TO RELATED APPLICATIONS

This application is an U.S. national stage of PCT/CN2012/080207, filed on Aug. 16, 2012, which claims priority to Chinese Patent Application No. 201110250145.3, filed on Aug. 29, 2011, the contents of which are each incorporated herein by reference in its entirety.

FIELD OF THE INVENTION

The present invention relates to the technical field of small household electrical appliances, and particularly relates to a glass wiping device and a control method thereof.

BACKGROUND OF THE PRIOR ART

At present, the typical glass wiping device available on the market is generally composed of a driver mechanism and a follower mechanism, wherein the driver mechanism and the follower mechanism are adsorbed on both sides of the glass to be cleaned through the magnetic force of the built-in magnets thereof, and the follower mechanism is designed to follow the driver mechanism to make a synchronous movement under the action of magnetic adsorption force, thereby performing cleaning work. However, the following problems often occur in its practical applications. Since both the driver mechanism and the follower mechanism are adsorbed on both sides of the glass through the magnetic force of magnets and different glass plates vary in thickness, if the glass plate is too thick while the magnetic force is too small, the driver mechanism and the follower mechanism cannot be fixed and will fall off from the glass plate, thus causing hazard or damage; or the follower mechanism will fail to follow the footprint of driver mechanism; If the glass plate is too think while the magnetic force is too big, the glass wiping device will generate excessive pressure on the glass plate, thus it may easily cause difficulty in the travel of glass wiping device and even result in fragmentation of glass and injury.

SUMMARY OF THE INVENTION

The technical object of the present invention is to provide a glass wiping device which is provided with pressure sensor and can adjust the magnetic force, so as to overcome the deficiencies of the prior art. In the by the glass wiping device, when being placed on both sides of glass, the pressure generated by the driver mechanism and the follower mechanism on the glass can be measured and thus the required adjustment quantity of magnetic force is determined, so as to ensure that the driver mechanism and the follower mechanism can be safely fixed on the glass plate.

The technical object of the present invention is achieved through the following technical solutions.

A glass wiping device is provided, comprising a driver mechanism and a follower mechanism which are respectively provided with a first magnet unit and a second magnet unit and are respectively adsorbed on both the inside and outside of glass through a mutual magnetic adsorption force generated between the first and second magnet units, the follower mechanism being capable of making a follow-up motion with the driver mechanism. A pressure induction unit comprising a pressure sensor and a controller is provided on the driver mechanism, and a pressure indicating device is provided on the driver mechanism or the follower mechanism, wherein the pressure sensor is configured to sense a pressure generated by the driver mechanism and the follower mechanism on the glass, and after receiving a pressure signal transmitted from the pressure sensor, the controller controls the pressure indicating device to display correspondingly.

The driver mechanism is provided with a follower wheel and a follower wheel bracket, and the pressure sensor comprises a strain gauge disposed on the follower wheel bracket. When the follower wheel is subjected to a pressure F, the follower wheel bracket and the strain gauge generate an elastic deformation, and the pressure sensor correspondingly outputs the pressure signal to the controller according to the elastic deformation.

A glass wiping device is also provided, comprising a driver mechanism and a follower mechanism which are respectively provided with a first magnet unit and a second magnet unit and are respectively adsorbed on both the inside and outside of glass through a mutual magnetic adsorption force generated between the first and second magnet units, the follower mechanism being capable of making a follow-up motion with the driver mechanism. A pressure induction unit comprising a pressure sensor and a controller is provided on the follower mechanism, and a pressure indicating device is provided on the driver mechanism or the follower mechanism, wherein the pressure sensor is configured to sense a pressure generated by the driver mechanism and the follower mechanism on the glass, and after receiving a pressure signal transmitted from the pressure sensor, the controller controls the pressure indicating device to display correspondingly.

The follower mechanism is provided with a follower wheel and a follower wheel bracket, and the pressure sensor comprises a strain gauge disposed on the follower wheel bracket. When the follower wheel is subjected to a pressure F, the follower wheel bracket and the strain gauge generate an elastic deformation, and the pressure sensor correspondingly outputs the pressure signal to the controller according to the elastic deformation.

Preferably, in said two glass wiping devices, the pressure indicating device is a LED indicating lamp, a speaker or a LCD panel indicator; the controller is configured to convert the pressure signal transmitted from the pressure sensor to a pressure value and to compare the pressure value with a pressure threshold preset in the controller; and at least one of the first magnet unit and the second magnet unit is an operable component, and the magnetic force between the first magnet unit and the second magnet unit is changed by operating the operable component.

The glass wiping devices comprise a rotating handle that is engaged with the first magnet unit or the second magnet unit and is configured to adjust the magnetic adsorption force between the first magnet unit and the second magnet unit.

Further, the glass wiping devices also comprise a supporting member that is adsorbed on the surface of glass and is engaged with the driver mechanism or the follower mechanism so that the driver mechanism or the follower mechanism remains still relative to the glass.

The present invention also provides a control method of a glass wiping device, comprising the following steps:

a. placing a driver mechanism or a follower mechanism on one surface of glass;

b. placing the follower mechanism or the driver mechanism on a corresponding position on the other surface of the glass;

c. after receiving a pressure signal transmitted from a pressure sensor, a controller controls a pressure indicating device to display correspondingly.

Specifically, the step c comprises: after receiving the pressure signal transmitted from the pressure sensor, the controller converts the pressure signal transmitted from the pressure sensor to a pressure value and compares the pressure value with a pressure threshold preset in the controller; if the pressure value is within the range of the preset pressure value, the pressure indicating device displays a normal state information.

The following step is performed prior to the step a: fixing a supporting member on the surface of the glass through adsorption, so that the driver mechanism or the follower mechanism to be subsequently engaged with the supporting member remains still relative to the glass.

The following step is performed after the step c:

d. when the pressure indicating device displays the normal state information, starting the operation of the glass wiping device; otherwise, adjusting the magnetic force between the first magnet unit and the second magnet unit, so that the magnetic force between the first magnet unit and the second magnet unit are within the range of the preset pressure threshold.

The magnetic force between the driver mechanism and the follower mechanism is adjusted through a rotating handle.

With the said technical solutions, it is feasible to determine the pressure generated by both the driver mechanism and the follower mechanism on the glass and thus judge the required adjustment quantity of magnetic force, so as to ensure that the driver mechanism and the follower mechanism can be safely fixed on the glass plate.

The present invention is further described in detail with reference to the attached drawings and the embodiments.

DESCRIPTION OF ATTACHED DRAWINGS

DETAILED DESCRIPTION OF PREFERRED EMBODIMENTS

Figure 1A:
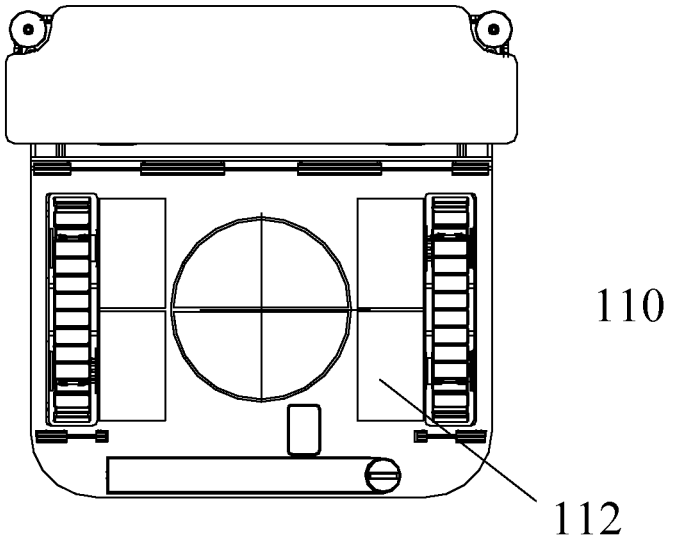
FIG. 1A illustrates the configuration diagram of the driver mechanism in the glass wiping device according to the present invention.
Figure 1B:
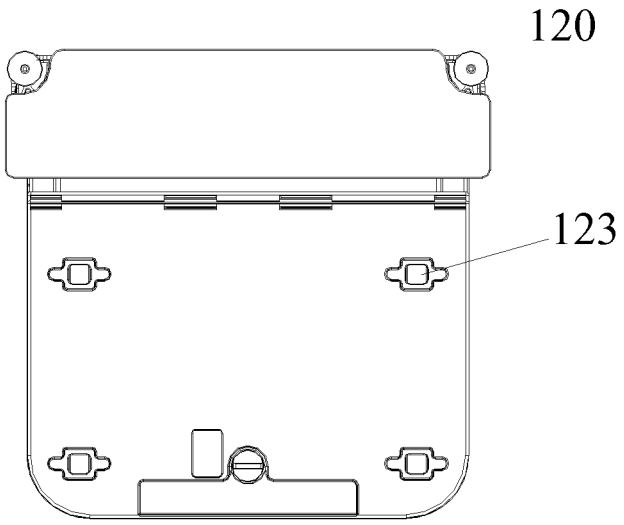
FIG. 1B illustrates the back configuration diagram of the follower mechanism in the glass wiping device according to the present invention.
Figure 1C:
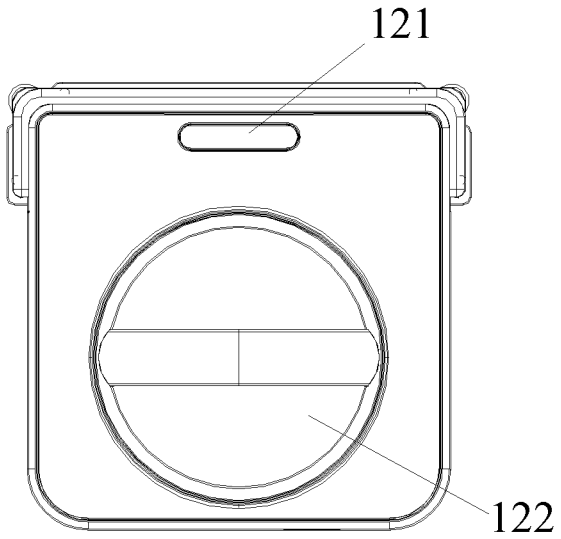
FIG. 1C is the front configuration diagram of the follower mechanism in the glass wiping device according to the present invention.
Figure 2:
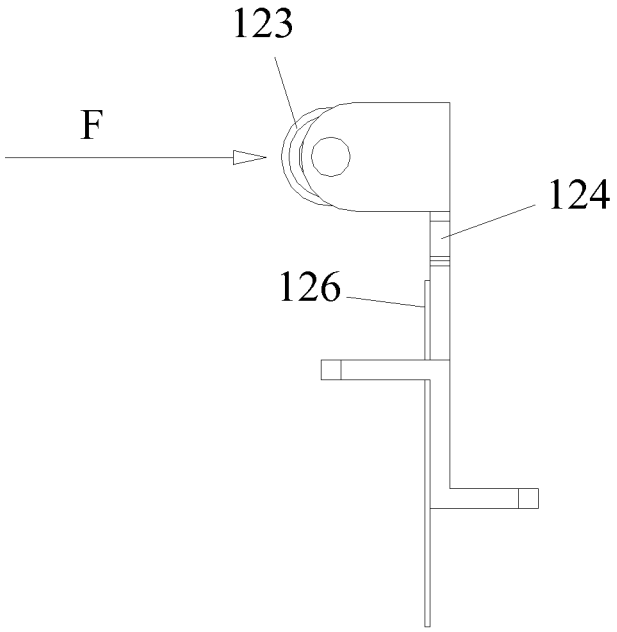
FIG. 2 illustrates the side configuration diagram of the strain gauge on the follower wheel according to the present invention.
Figure 3:
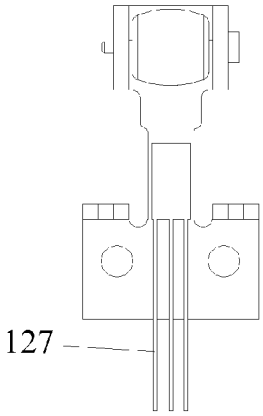
FIG. 3 illustrates the front configuration diagram of the strain gauge on the follower wheel according to the present invention.

FIG. 1A illustrates the configuration diagram of the driver mechanism in the glass wiping device according to the present invention; FIG. 1B illustrates the back configuration diagram of the follower mechanism in the glass wiping device according to the present invention; FIG. 1C is the front configuration diagram of the follower mechanism in the glass wiping device according to the present invention; FIG. 2 illustrates the side configuration diagram of the strain gauge on the follower wheel according to the present invention; and FIG. 3 illustrates the front configuration diagram of the strain gauge on the follower wheel according to the present invention. As shown in FIGS. 1A-1C, the glass wiping device comprises a driver mechanism 110 and a driver mechanism 120, wherein a first magnet unit is provided inside the driver mechanism 110 and a second magnet unit is provided inside the driver mechanism 120; through the mutual magnetic adsorption force between the first magnet unit and the second magnet unit, the driver mechanism 110 and the follower mechanism 120 are respectively adsorbed on both the inside and the outside of the glass, and the follower mechanism 120 can make a follow-up motion with the driver mechanism 110 under the adsorption force between the first magnet unit and the second magnet unit. A rotating handle 122 is provided on the follower mechanism 120, and by operating the rotating handle 122, the magnetic force between the first magnet unit and the second magnet unit can be changed. A work piece 112 is provided on the driver mechanism 110, wherein the work piece can be any of cleaning appliances such as scraping strip, flannelette, scouring pad and the like. In addition, a pressure sensor (not shown) is provided on the follower mechanism 120. When the driver mechanism 110 and the follower mechanism 120 have been adsorbed on both surface sides of the glass through the above internal magnet units and then the follower wheel 123 on the follower mechanism 120 is subjected to the pressure F (as shown in FIG. 2), a follower wheel bracket 124 will generate an elastic deformation, and a built-in strain gauge 126 in the sensor (not shown) attached on the surface of the follower wheel 123 will sense this elastic deformation, so as to transmit a pressure signal to a controller (as shown in FIG. 3) through a strain gauge output wire 127. According to this pressure signal, the controller calculates the magnitude of the pressure G received at this time and thus makes the following judgment. In case of normal pressure, a pressure indicating device 121 provided on the follower mechanism 120 will display the information of normal state, and the glass wiping device can start operation normally. In case of abnormal pressure, the pressure indicating device 121 will display the information of abnormal state, and the gas-wiping device will fail in normal operation. The pressure indicating device 121 is a LED indication lamp, a speaker or a LCD panel indicator. Normal pressure is indicated when the LED light is on, when the pointer points to the center of LCD panel or when the speaker does not sound.

Figure 4:
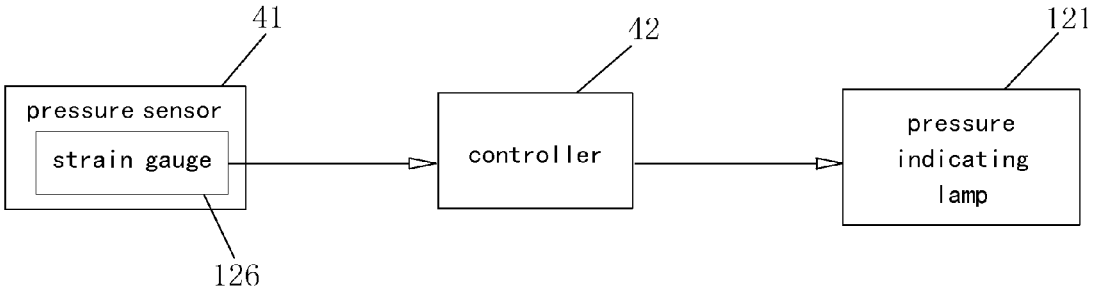
FIG. 4 illustrates the operating principle diagram of the sensor according to the present invention.
Figure 5A:
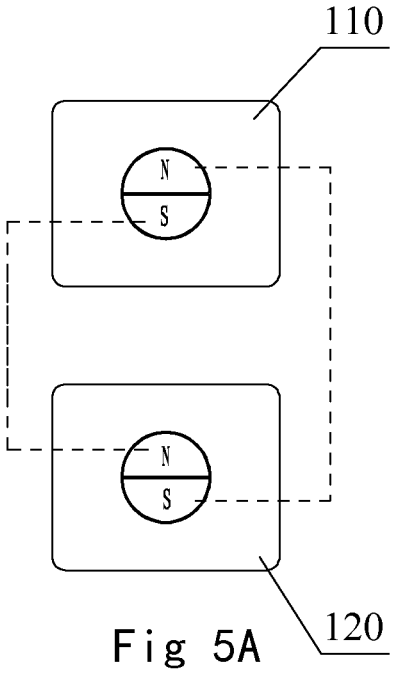
FIGS. 5A-5C illustrate the configuration diagram of the change of magnetic force in the glass wiping device according to the present invention.
Figure 5B:
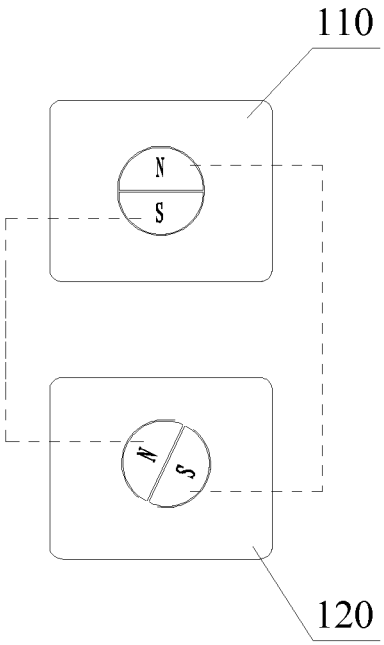
Figure 5C:
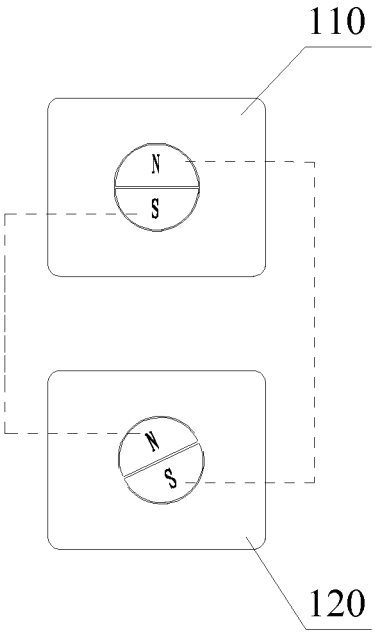

FIG. 4 illustrates the operating principle diagram of the sensor according to the present invention; FIGS. 5A-5C illustrate the configuration diagram of the change of magnetic force in the glass wiping device of the present invention. As shown in FIG. 4 together with FIGS. 5A-5C, the control method of the glass wiping device comprises the following steps. First, when the glass wiping device starts to operate, the driver mechanism 110 or the follower mechanism 120 is placed on one surface of glass, and the follower mechanism 120 or the driver mechanism 110 is placed on the corresponding position on another surface of the glass. Second, as shown in FIG. 5A, when the magnetic force between the driver mechanism 110 and the follower mechanism 120 reaches the maximum, the pressure sensor 41 outputs a pressure signal to the controller 42, and the controller 42 calculates the pressure value and compares the calculated value with the pressure threshold preset in the controller 42 (for example, the range of the pressure threshold is 50 N-80 N). If the pressure value is greater than the maximum threshold (for example, 80 N), the controller 42 sends a control signal to allow the pressure indicating device 121 to display the abnormal state information. At this time, the user can rotate the second magnet unit by operating the rotating handle 122 on the follower mechanism 120, so as to change the magnetic adsorption force (as shown in FIG. 5B) between the driver mechanism 110 and the follower mechanism 120. The strain gauge 126 provided on the follower mechanism 120 senses the pressure and outputs a pressure signal to the controller 42 through the strain gauge output conductor 127. The controller 42 calculates the pressure value and compares the calculated pressure value with the pressure threshold preset in the controller 42. If the calculated pressure value is less than the minimum threshold (for example, 50 N), the controller 42 sends a control signal to allow the pressure indicating device 121 to display the abnormal state information. At this time, the user can rotate the second magnet unit by operating the rotating handle 122 on the follower mechanism 120, so that the magnetic adsorption force between the driver mechanism 110 and the follower mechanism 120 increases (as shown in FIG. 5C). The strain gauge 126 provided on the follower mechanism 120 senses the pressure and outputs the pressure signal to the controller 42 through the strain gauge output conductor 127. The controller 42 calculates the pressure value and compares the calculated pressure value with the pressure threshold preset in the controller 42. If the calculated pressure value is just within the range of pressure threshold, the controller 42 sends a control signal to allow the pressure indicating device 121 to display normal state, indicating that the glass wiping deice can perform normal operation under this pressure.

In addition to the above, the pressure sensor in the glass wiping device of the present invention can be designed such that when the pressure is abnormal, the pressure indicating device 121 can display abnormal state information according to different indication device components. The present invention is not limited to the displayed states of the above-mentioned indication device 121. Those skilled in the art may make equivalent modifications according to the above embodiments, and such equivalent modifications also fall within the claims of the present invention.

In addition, the rotating handle 122 may be provided on the driver mechanism 110.

Figure 6:
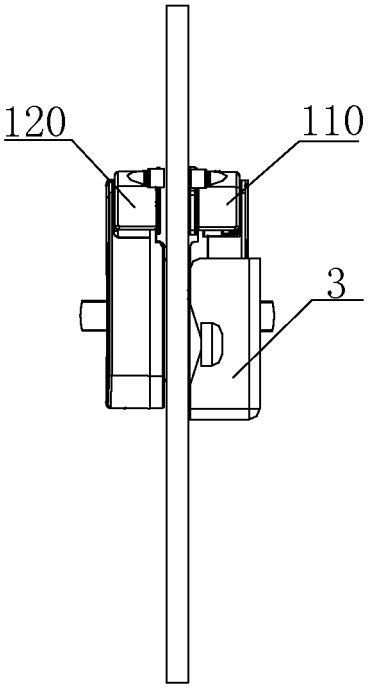
FIG. 6 is the configuration diagram of the glass wiping device with a supporting member according to the present invention.

FIG. 6 is the configuration diagram of the glass wiping device with a supporting member according to the present invention. As shown in FIG. 6, the glass wiping device further comprises a supporting member 3, wherein this supporting member 3 is adsorbed on the surface of the glass and is engaged with the driver mechanism or the follower mechanism so that the driver mechanism 110 or the follower mechanism 120 remains still relative to the glass. To be specific, when the glass wiping device starts to operate, the supporting member 3 is placed at a corner on the inside (or outside) of the glass to be cleaned, the driver mechanism 110 or the follower mechanism 120 is then placed on the supporting member 3, and then the follower mechanism 120 or the driver mechanism 110 is placed on the corresponding position on the outside (or inside) of the glass. In such case, the driver mechanism 110 and the follower mechanism 120 can be respectively adsorbed on both sides of the glass through the magnetic force of magnet. By taking down the supporting member 3, the user may start the driver mechanism 3 to clean the glass. If the user wants to withdraw the glass wiping device after completion of cleaning, the user may firstly place the supporting member 3 beneath the driver mechanism 110 (or the follower mechanism 120), then take down the follower mechanism 120 (or the driver mechanism 110), then take down the driver mechanism 110 (or the follower mechanism 120), and finally take down the supporting member 3. Hereafter, the glass wiping device and the supporting member 3 are properly kept.

Of course, the technical solution of the present invention may also adopt other modifications. For example, the pressure sensor may be set on the driver mechanism. Similar to the above-mentioned follower mechanism, a follower wheel may be provided on the center at the bottom of driver mechanism, and the strain gauge of this pressure sensor is provided on the follower wheel bracket. After receiving the pressure signal transmitted from the pressure sensor, the controller on the driver mechanism controls the pressure indicating device to display correspondingly. In addition, the pressure indicating device may be provided on the driver mechanism or the follower mechanism separately from the pressure sensor. For example, the pressure sensor is provided on the follower mechanism. After receiving pressure signal, the controller on the follower mechanism controls the pressure indicating device provided on the driver mechanism to display signal correspondingly.

To sum up, the pressure sensor in the glass wiping device can determine the pressure generated by both the driver mechanism and the follower mechanism on the glass and thus judge the required adjustment quantity of magnetic force, so as to ensure that the driver mechanism and the follower mechanism can be safely fixed on the glass plates with different thicknesses. The present invention can avoid the risk of dropping of glass wiping device due to too small pressure or the risk of travel difficulty of glass wiping device or glass crushing due to excessive pressure.

The invention claimed is:

1. A glass wiping device, comprising:

a driver mechanism and a follower mechanism which are respectively provided with a first magnet unit and a second magnet unit and are respectively adsorbed on both the inside and outside of glass through a mutual magnetic adsorption force generated between the first and second magnet units, the follower mechanism being capable of making a follow-up motion with the driver mechanism;

a pressure induction unit comprising a pressure sensor and a controller provided on the driver mechanism, and a pressure indicating device is provided on the driver mechanism or the follower mechanism, wherein the pressure sensor is configured to sense a pressure generated by the driver mechanism and the follower mechanism on the glass, and after receiving a pressure signal transmitted from the pressure sensor, the controller controls the pressure indicating device to display correspondingly.

2. The glass wiping device according to claim 1 wherein, in the case of the pressure induction unit being provided on the driver mechanism, the driver mechanism is provided with a follower wheel and a follower wheel bracket, or in the case of the pressure induction unit being provided on the follower mechanism, the follower mechanism is provided with the follower wheel and the follower wheel bracket, and the pressure sensor comprises a strain gauge disposed on the follower wheel bracket.

3. The glass wiping device according to claim 2 wherein, when the follower wheel is subjected to a pressure F, the follower wheel bracket and the strain gauge generate an elastic deformation, and the pressure sensor correspondingly outputs the pressure signal to the controller according to the elastic deformation.

4. The glass wiping device according to claim 1 wherein the pressure indicating device comprises a LED indicating lamp, a speaker or a LCD panel indicator.

5. The glass wiping device according to claim 1 wherein the controller is configured to convert the pressure signal transmitted from the pressure sensor to a pressure value and to compare the pressure value with a pressure threshold preset in the controller.

6. The glass wiping device according to claim 1 wherein at least one of the first magnet unit and the second magnet unit is an operable component, and the magnetic force between the first magnet unit and the second magnet unit is changed by operating the operable component.

7. The glass wiping device according to claim 6, wherein the glass wiping device comprises a rotating handle that is engaged with the first magnet unit or the second magnet unit and is configured to adjust the magnetic adsorption force between the first magnet unit and the second magnet unit.

8. The glass wiping device according to claim 1, wherein the glass wiping device further comprises a supporting member that is adsorbed on the surface of glass and is engaged with the driver mechanism or the follower mechanism so that the driver mechanism or the follower mechanism remains still relative to the glass.

9. A control method of a glass wiping device, comprising the following steps:

a. placing a driver mechanism or a follower mechanism on one surface of glass;

b. placing the follower mechanism or the driver mechanism on a corresponding position on the other surface of the glass;

c. after receiving a pressure signal transmitted from a pressure sensor, a controller controls a pressure indicating device to display correspondingly.

10. The control method according to claim 9, wherein the step c further comprises: after receiving the pressure signal transmitted from the pressure sensor, the controller converts the pressure signal transmitted from the pressure sensor to a pressure value and compares the pressure value with a pressure threshold preset in the controller; if the pressure value is within the range of the preset pressure value, the pressure indicating device displays a normal state information.

11. The control method according to claim 10, further comprising the following step after the step c:

d. when the pressure indicating device displays the normal state information, starting the operation of the glass wiping device; otherwise, adjusting the magnetic force between the first magnet unit and the second magnet unit, so that the magnetic force between the first magnet unit and the second magnet unit are within the range of the preset pressure threshold.

12. The control method according to claim 11, wherein the magnetic force between the driver mechanism and the follower mechanism is adjusted through a rotating handle.

13. The control method according to claim 9, further comprising the following step prior to the step a: fixing a supporting member on the surface of the glass through adsorption, so that the driver mechanism or the follower mechanism to be subsequently engaged with the supporting member remains still relative to the glass.

* * * * *